US010578263B2

(12) United States Patent
Dong

(10) Patent No.: US 10,578,263 B2
(45) Date of Patent: Mar. 3, 2020

(54) ARTIFICIAL CANDLE LAMP

(71) Applicant: Zhenfu Dong, Zhejiang (CN)

(72) Inventor: Zhenfu Dong, Zhejiang (CN)

( * ) Notice: Subject to any disclaimer, the term of this patent is extended or adjusted under 35 U.S.C. 154(b) by 0 days.

(21) Appl. No.: 16/145,028

(22) Filed: Sep. 27, 2018

(65) Prior Publication Data

US 2019/0316747 A1 Oct. 17, 2019

(30) Foreign Application Priority Data

Apr. 16, 2018 (CN) ..... 2018 2 0537728 U

(51) Int. Cl.
*F21S 10/04* (2006.01)

(52) U.S. Cl.
CPC ..... *F21S 10/046* (2013.01)

(58) Field of Classification Search
CPC ..... F21S 10/046
See application file for complete search history.

(56) References Cited

U.S. PATENT DOCUMENTS 8,132,936 B2 * 3/2012 Patton ..... F21S 10/04 362/249.02
9,388,954 B2 * 7/2016 Lai ..... F21S 10/046
9,585,980 B1 * 3/2017 Li ..... F21S 6/001
9,664,349 B1 * 5/2017 Hurduc ..... F21S 10/046
9,909,728 B2 * 3/2018 Dong ..... F21S 10/046
10,240,735 B1 * 3/2019 Huang ..... F21S 10/04
2006/0146544 A1 * 7/2006 Leung ..... F21S 6/001 362/392
2012/0300459 A1 * 11/2012 Hau ..... F21S 10/046 362/249.02
2014/0211499 A1 * 7/2014 Fong ..... F21S 6/001 362/558
2014/0362592 A1 * 12/2014 Lee ..... F21S 10/046 362/386
2015/0055331 A1 * 2/2015 Lai ..... F21S 10/046 362/186
2015/0233538 A1 * 8/2015 Sheng ..... F21S 10/046 362/190
2016/0053954 A1 * 2/2016 Lai ..... F21S 10/046 362/393
2016/0116127 A1 * 4/2016 Patton ..... F21S 6/001 362/284
2018/0010750 A1 * 1/2018 Cheng ..... G02B 6/0006
2018/0372289 A1 * 12/2018 Hu ..... F21S 10/046
2019/0113195 A1 * 4/2019 Sheng ..... F21S 6/001

* cited by examiner

*Primary Examiner* — Donald L Raleigh
(74) *Attorney, Agent, or Firm* — Wayne & Ken, LLC; Tony Hom

(57) ABSTRACT

The present invention discloses an artificial candle lamp, including an artificial flame hood and a light-emitting component which emits light in the flame hood. The light-emitting component is disposed on an upper bracket; a lower bracket is disposed below the upper bracket; an elastic component is disposed between the upper bracket and the lower bracket; an inductance solenoid coil is disposed in the middle of the lower bracket; and a ferromagnet which extends into the inductance solenoid coil is disposed at a lower part of the upper bracket. In the technical solution, the elastic component is used to buffer the flicker generated by an electromagnetic force to form a random and gradually-attenuated flicker process, thereby effectively enhancing a simulation effect of flame flicker of the artificial candle lamp and improving use experience of a user.

7 Claims, 2 Drawing Sheets

ARTIFICIAL CANDLE LAMP

CROSS-REFERENCE TO RELATED APPLICATIONS

This application claims to Chinese Application No. 201820537728.1 with a filing date of Apr. 16, 2018. The content of the aforementioned applications, including any intervening amendments thereto, are incorporated herein by reference.

TECHNICAL FIELD

The present invention relates to an electronic light-emitting apparatus, and more particularly to an electronic light-emitting apparatus which simulates a candle.

BACKGROUND

Because of safety and environmental protection, artificial electronic candles are widely used to replace traditional candles in many occasions. However, in order to make the flame of the artificial electronic candles more realistic, people use various disturbance mechanisms to make the flame piece swing to achieve the candlelight flickering effect of a real candle. A Chinese utility model with publication number of CN 203980132U discloses an artificial electronic candle which includes a housing, a flame piece disposed in an opening on top of the housing through a transverse supporting rod, a light-emitting element disposed on one side of the opening, and a disturbance apparatus disposed in the housing. The flame piece is intersected and connected to the supporting rod through a vertical swinging rod. Part of an upper part of the swinging rod extends into a lower part of the flame piece. Parts of an upper part and a lower part of the flame piece are located above the opening. The direction of light projection of the light-emitting element intersects the surface of the flame piece. In this technical solution, two electromagnetic coils are randomly energized alternately to form random swinging forces on the swinging rod, thereby realizing random swing of the flame piece. Although the technical solution realizes flicker of the flame piece through a repulsive force between the electromagnetic coils and a magnet on the swinging rod, because the repulsive forces generated by energizing and deenergizing the electromagnetic coils lack of buffer performance, the flicker of the flame piece seems stiff and unnatural and a simulation effect is poor, thereby influencing use experience of a user. Moreover, in the technical solution, the electromagnetic coils need a circuit board to generate a varying and continuous control current, and thus need complicated control programs and need to consume more power.

SUMMARY

The technical problem to be solved by the present invention is to provide an artificial candle lamp. An elastic component is used to buffer the flicker generated by an electromagnetic force to form a random and gradually-attenuated flicker process, thereby effectively enhancing a simulation effect of flame flicker of the artificial candle lamp and improving use experience of a user. In addition, by means of dual effects of upward flicker of an elastic element disposed in the elastic component and downward pressing of a precompression element, the artificial candle lamp generates a more lasting and softer flicker effect and the experience effect of the user is better. Moreover, the technical solution has the technical characteristics of no need of complicated control programs and low power consumption.

To solve the above technical problem, the present invention adopts the following technical solution: An artificial candle lamp includes an artificial flame hood and a light-emitting component which emits light in the flame hood, where the light-emitting component is disposed on an upper bracket; a lower bracket is disposed below the upper bracket; an elastic component is disposed between the upper bracket and the lower bracket; an inductance solenoid coil is disposed in the middle of the lower bracket; and a ferromagnet which extends into the inductance solenoid coil is disposed at a lower part of the upper bracket. In the technical solution, the elastic component is used to buffer the flicker generated by an electromagnetic force to form a random and gradually-attenuated flicker process, thereby effectively enhancing a simulation effect of flame flicker of the artificial candle lamp and improving use experience of the user. Moreover, the technical solution has the technical characteristics of no need of complicated control programs and low power consumption.

Preferably, the elastic component includes a compressed elastic element disposed between the upper bracket and the lower bracket and a precompression element which precompresses the compressed elastic element. By means of dual effects of upward flicker of the elastic element disposed in the elastic component and downward pressing of the precompression element, the artificial candle lamp generates a more lasting and softer flicker effect and the experience effect of the user is better.

Preferably, the compressed elastic element is a conical compression spring having a smaller top and a larger bottom. Through the adoption of the compressed elastic element of the conical compression spring, stability control for the upper bracket is better, thereby preventing the upper bracket from greatly swinging under the effect of an inertia force.

Preferably, the precompression element is a counterweight disposed on the upper bracket. Because the counterweight is used as the precompression element, the structure of the precompression element is simple and a simulation effect is better.

Specifically, the upper bracket includes an upper seat body, and a supporting rod fixed to the middle of the upper seat body and having a crossed longitudinal section; and the ferromagnet is disposed in an inner cavity at a lower part of the supporting rod.

Further, an upper cover is also covered on the upper seat body; an upper cavity body is formed between the upper cover and the upper seat body; the counterweight is disposed in the upper cavity body; and a middle through hole for the supporting rod to pass through is formed in the middle of the upper cover and the counterweight. This specific structural solution hides the counterweight and realizes a better appearance.

Specifically, the upper seat body and the supporting rod form an integrated structure.

In the present invention, the elastic component is used to buffer the flicker generated by an electromagnetic force to form a random and gradually-attenuated flicker process, thereby effectively enhancing the simulation effect of flame flicker of the artificial candle lamp and improving use experience of the user. In addition, by means of dual effects of upward flicker of an elastic element disposed in the elastic component and downward pressing of the precompression element, the artificial candle lamp generates a more lasting and softer flicker effect and the experience effect of the user is better. Through inertial vibration of the elastic component, the inductance solenoid coil only needs the current of one pulse to form a gradually-attenuated natural-buffering flicker effect, and has better power saving effect.

Figure 1:
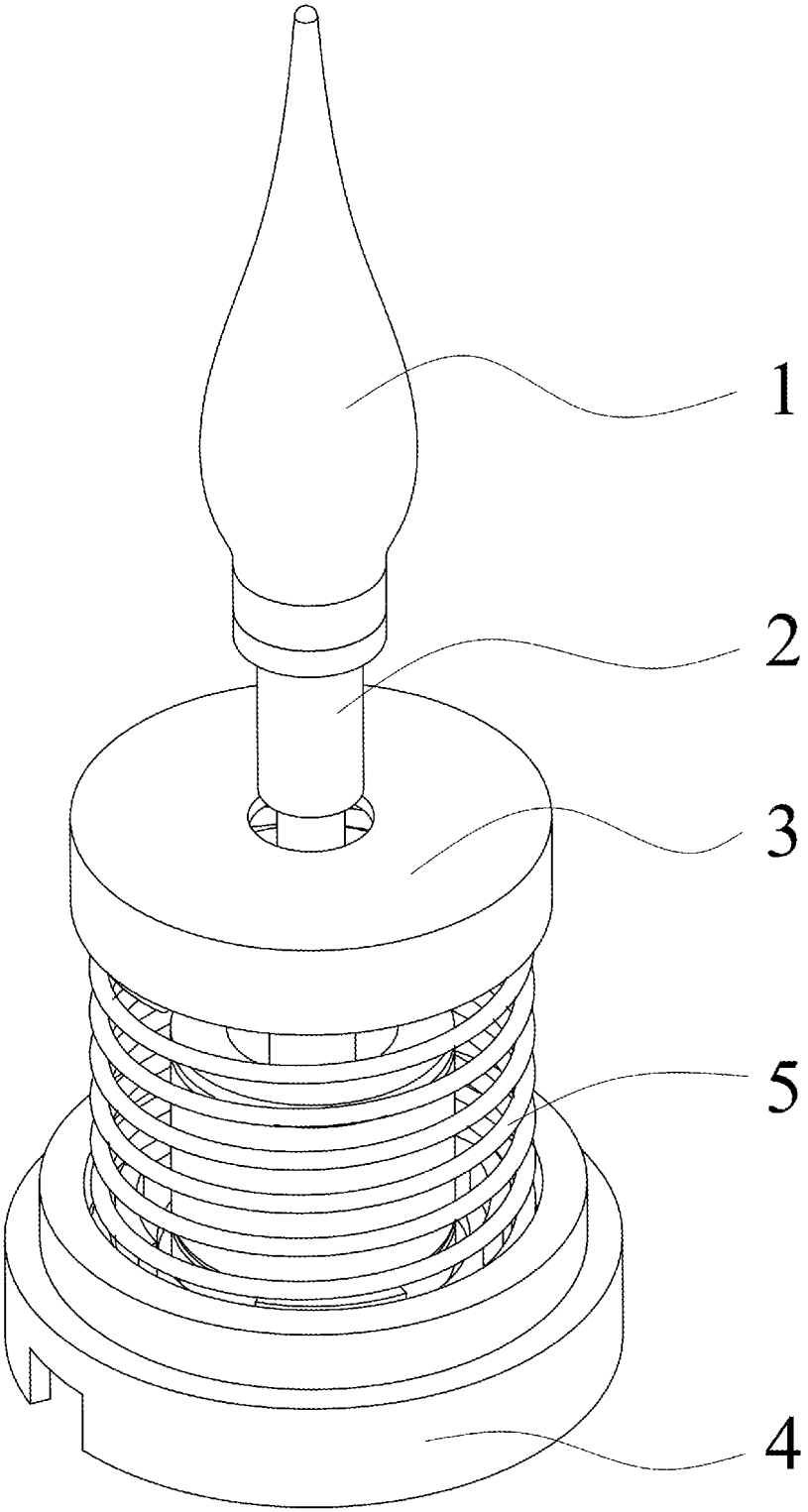
FIG. 1 is a structural schematic diagram of an embodiment 1 of the present invention.

In the figures: flame hood 1; light-emitting component 2; upper bracket 3; upper seat body 31; upper seat groove 311; supporting rod 32; upper cover 33; upper cavity body 34; ferromagnet 35; lower bracket 4; lower cavity body 41; lower seat groove 42; elastic component 5; compressed elastic element 51; precompression element 52; counterweight 521; circuit board 6; inductance solenoid coil 7; and coil 71.

DETAILED DESCRIPTION

The technical solution of the present invention is further described in detail below through specific embodiments in combination with drawings.

Figure 2:
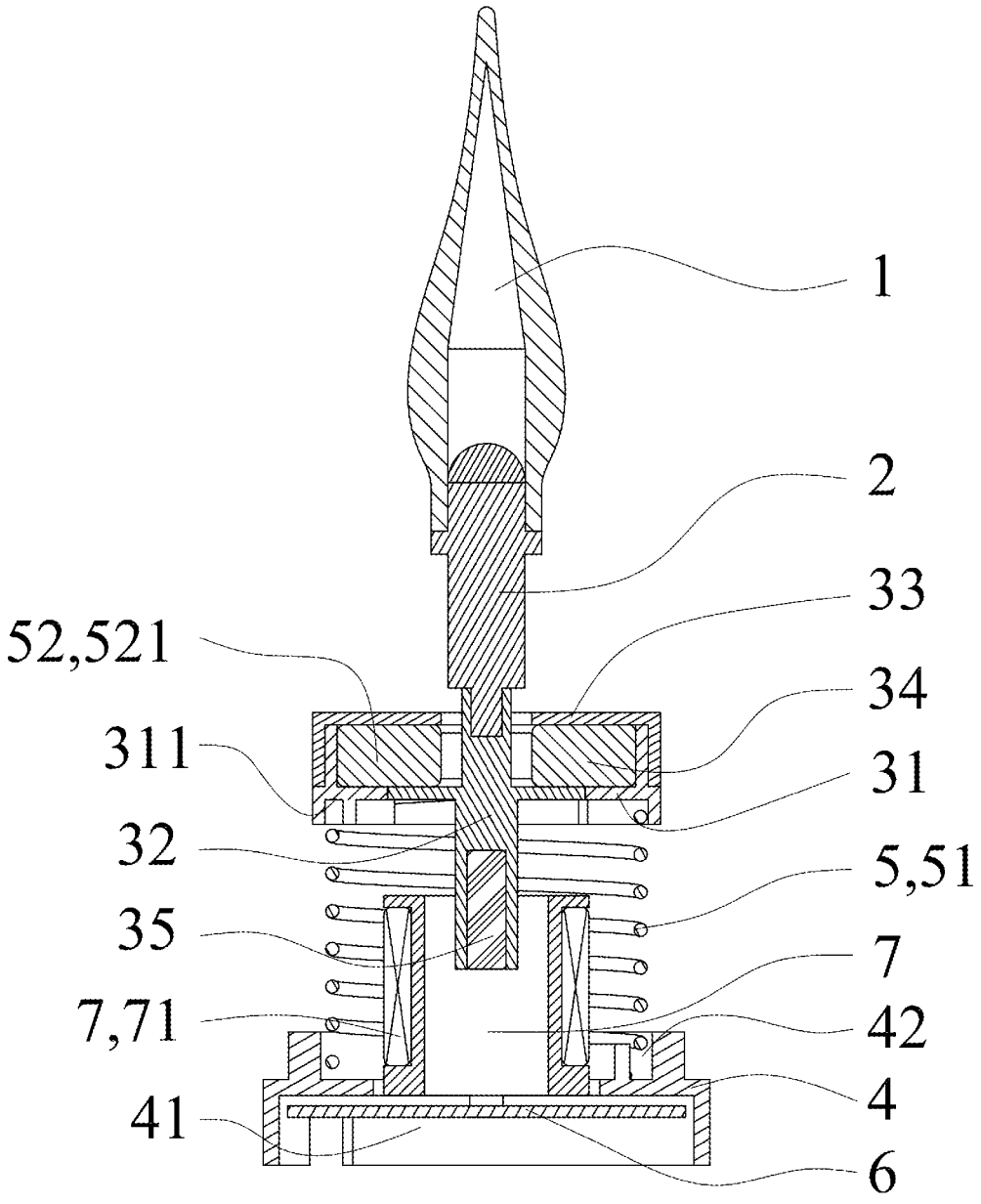
FIG. 2 is a sectional structural schematic diagram of an embodiment 1 of the present invention.

By referring to FIG. 1 and FIG. 2, an artificial candle lamp includes an upper bracket 3, a lower bracket 4, an elastic component 5 disposed between the upper bracket 3 and the lower bracket 4, a circuit board 6 disposed in a lower cavity body 41 of the lower bracket 4, an inductance solenoid coil 7 installed on the circuit board 6 and upwardly passing through a middle through hole of the lower bracket 4, a light-emitting component 2 disposed on the upper bracket 3, and a flame hood 1 covered on the light-emitting component 2. A power supply is connected to the circuit board 6. A coil 71 is wound on the inductance solenoid coil 7. The coil 71 is electrically connected with a circuit on the circuit board 6.

The elastic component 5 includes a compressed elastic element 51 and a precompression element 52. The upper bracket 3 includes an upper seat body 31, a supporting rod 32 which forms an integrated structure with the upper seat body 31, and an upper cover 33 covered on the upper seat body 31. The supporting rod 32 has a crossed longitudinal section. The light-emitting component 2 is connected to an upper part of the supporting rod 32. A lower part of the supporting rod 32 is provided with an inner cavity of the supporting rod 32. A ferromagnet 35 is disposed in the inner cavity. The lower part of the supporting rod 32 extends downwards and extends partially into a middle pipe cavity of the inductance solenoid coil 7. An upper seat groove 311 in an annular shape is formed near an outer ring below the upper seat body 31. A lower seat groove 42 in an annular shape is formed near the outer ring above the lower bracket 4. The compressed elastic element 51 is disposed between the upper seat groove 311 and the lower seat groove 42. In the present embodiment, the precompression element 52 is a counterweight 521. An upper cavity body 34 is formed between the upper cover 33 and the upper seat body 31. The counterweight 521 is disposed in the upper cavity body 34. The counterweight 521 precompresses one precompression amount to the compressed elastic element 51 through self weight. The maximum precompression amount of the counterweight 521 to the compressed elastic element 51 is less than a distance from the inductance solenoid coil 7 to a bottom surface of the upper seat body 31. The precompression element 52 may also be other structures (such as a tensile elastic element disposed between the upper bracket 3 and the lower bracket 4 or permanent magnets having opposite polarities and disposed between the upper bracket 3 and the lower bracket 4) which precompress one precompression amount to the compressed elastic element 51. The pressure of the precompression element 52 to the compressed elastic element 51 shall be slightly larger than the elastic force of the compressed elastic element 51, but smaller than the electromagnetic force generated after the inductance solenoid coil 7 is energized.

The electromagnetic force generated after the inductance solenoid coil 7 on the circuit board 6 is energized and the force generated by the ferromagnet 35 disposed in the inner cavity at the lower part of the supporting rod 32 attract or repel one another, so that the flame hood 1 and the light-emitting component 2 which are disposed on the upper bracket 3 overcome the elastic force of the elastic component 5 and generate flicker. Because of the existence of the elastic component 5, the coil 71 on the inductance solenoid coil 7 is not required to be energized continuously. After the inductance solenoid coil 7 generates a flicker impulsive force for the ferromagnet, the upper bracket 3 generates a delayed vibration under the effect of the inertia force of the compressed elastic element 51 in the elastic component 5 and the counterweight 521 used as the precompression element 52, so that the flame hood 1 generates a natural flicker effect. Further, when the inductance solenoid coil 7 is controlled to generate the electromagnetic forces of different sizes, a variable-size and variable-height natural flicker effect of the flame is generated within a certain time by means of inertial synergy with the elastic component 5.

Specific embodiments are used to understand the present invention more clearly, not used as a limitation to rights of the present invention. Various changes can be made without deviating from the purpose of the present invention. All these modifications, which are apparent to those skilled in the art, will be included in the scope of the claims.

What is claimed is:

1. An artificial candle lamp, comprising an artificial flame hood and a light-emitting component for emitting light in the artificial flame hood; wherein the light-emitting component is disposed on an upper bracket; a lower bracket is disposed below the upper bracket; an elastic component is disposed between the upper bracket and the lower bracket, to provide an elastic force against the upper bracket and the lower bracket in a vertical direction; an inductance solenoid coil is disposed in the middle of the lower bracket inside the elastic component; and a ferromagnet extending into the inductance solenoid coil is disposed at a lower part of the upper bracket.

2. The artificial candle lamp according to claim 1, wherein the elastic component comprises a compressed elastic element disposed between the upper bracket and the lower bracket and a precompression element for precompressing the compressed elastic element.

3. The artificial candle lamp according to claim 2, wherein the compressed elastic element is a conical compression spring having a smaller top and a larger bottom.

4. The artificial candle lamp according to claim 2, wherein the precompression element is a counterweight disposed on the upper bracket.

5. The artificial candle lamp according to claim 1, wherein the upper bracket comprises an upper seat body, and a supporting rod fixed to the middle of the upper seat body and having a crossed longitudinal section; and the ferromagnet is disposed in an inner cavity at a lower part of the supporting rod.

6. The artificial candle lamp according to claim 5, wherein an upper cover is also covered on the upper seat body; an upper cavity body is formed between the upper cover and the upper seat body; the counterweight is disposed in the upper cavity body; and a middle through hole for the supporting rod to pass through is formed in the middle of the upper cover and the counterweight.

7. The artificial candle lamp according to claim 5, wherein the upper seat body and the supporting rod form an integrated structure.

* * * * *